US007216594B2

(12) United States Patent
Nowak et al.

(10) Patent No.: US 7,216,594 B2
(45) Date of Patent: May 15, 2007

(54) MULTIPLE SEGMENT CERAMIC FUEL NOZZLE TIP

(75) Inventors: Ronald H. Nowak, Longmeadow, MA (US); Jeffrey S. Mann, Windsor, CT (US)

(73) Assignee: Alstom Technology, Ltc. (CH)

( * ) Notice: Subject to any disclaimer, the term of this patent is extended or adjusted under 35 U.S.C. 154(b) by 0 days.

(21) Appl. No.: 11/119,942

(22) Filed: May 3, 2005

(65) Prior Publication Data

US 2006/0249061 A1 Nov. 9, 2006

(51) Int. Cl.
*F23C 1/10* (2006.01)
*F23C 1/12* (2006.01)
*F23D 1/00* (2006.01)

(52) U.S. Cl. ..... 110/261; 110/263

(58) Field of Classification Search ..... 110/261–265; 239/423, 424, 424.5

See application file for complete search history.

(56) References Cited

U.S. PATENT DOCUMENTS 2,895,435 A 7/1959 Bogot et al.
4,274,343 A 6/1981 Kokkinos
4,356,975 A 11/1982 Chadshay
4,434,727 A 3/1984 McCartney
4,520,739 A 6/1985 McCartney et al.
4,634,054 A 1/1987 Grusha
4,719,587 A 1/1988 Berte
5,315,939 A 5/1994 Rini et al.
6,089,171 A 7/2000 Fong et al.
6,439,136 B1 8/2002 Mann et al.
6,805,773 B1 * 10/2004 Brooker ..... 202/224

* cited by examiner

*Primary Examiner*—Kenneth Rinehart
(74) *Attorney, Agent, or Firm*—Antonelli, Terry, Stout, & Kraus, LLP

(57) ABSTRACT

A solid fuel nozzle tip (201) having at least first (205) and second (207) ceramic shells is provided by the present invention. An inlet end of the first ceramic shell (205) is interconnected to a pulverized solid fuel nozzle (34), and an outlet end (301) of the first ceramic shell (205) is interconnected to an inlet end (305) of the second ceramic shell (207).

12 Claims, 9 Drawing Sheets

MULTIPLE SEGMENT CERAMIC FUEL NOZZLE TIP

FIELD OF THE INVENTION

This invention is related to firing systems for use with pulverized solid fuel-fired furnaces, and more specifically, to a multiple segment pulverized solid fuel nozzle tip with a ceramic component for use in such firing systems.

BACKGROUND OF THE INVENTION

It has long been known in the art to employ pulverized solid fuel nozzle tips in firing systems of the type that are utilized in pulverized solid fuel-fired furnaces. A typical pulverized solid fuel nozzle tip comprises inner and outer shells disposed coaxially in spaced relationship to define a first flow passageway within the inner shell through which a pulverized fuel and air mixture passes into a furnace, and a second flow passageway between the inner shell and the outer shell through which air passes into the furnace. Typically, one or more splitter plates are disposed within the inner shell parallel to the axis of the nozzle tip to divide the flow passageway within the inner shell into multiple sub-passages. Oftentimes nozzle tips are configured so as to be tiltable upward or downward in order to direct the fuel-air mixture discharging into the furnace.

Examples of pulverized solid fuel nozzle tips can be found in U.S. Pat. No. 2,895,435 entitled "Tilting Nozzle For Fuel Burner", which issued on Jul. 21, 1959 and which is assigned to the same assignee as the present patent application; U.S. Pat. No. 4,274,343 entitled "Low Load Coal Nozzle", which issued on Jun. 23, 1981 and which is assigned to the same assignee as the present patent application; U.S. Pat. No. 4,356,975 entitled "Nozzle Tip For Pulverized Coal Burner", which issued on Nov. 2, 1982 and which is assigned to the same assignee as the present patent application; U.S. Pat. No. 4,434,727 entitled "Method For Low Load Operation Of A Coal-Fired Furnace", which issued on Mar. 6, 1984 and which is assigned to the same assignee as the present patent application; U.S. Pat. No. 4,520,739 entitled "Nozzle Tip For Pulverized Coal Burner", which issued on Jun. 4, 1985 and which is assigned to the same assignee as the present patent application; U.S. Pat. No. 4,634,054 entitled "Split Nozzle Tip For Pulverized Coal Burner", which issued on Jan. 6, 1987 and which is assigned to the same assignee as the present patent application; U.S. Pat. No. 5,315,939 entitled "Integrated Low $NO_x$ Tangential Firing System", which issued on May 31, 1994 and which is assigned to the same assignee as the present patent application; and U.S. Pat. No. 6,089,171 entitled "Minimum Recirculation Flame Control (MRFC) Pulverized Solid Fuel Nozzle Tip", which issued on Jul. 18, 2000 and which is assigned to the same assignee as the present patent application.

A common material composition for pulverized solid fuel nozzle tips is stainless steel. Typically, a stainless steel used in such a nozzle tip is one with a relatively high temperature rating. While stainless steel has several desirable material properties, including ease of effort in incorporating it into the finished product, toughness, durability, high temperature strength, and ductility, certain material properties of conventional pulverized solid fuel nozzle tips comprised of stainless steel often force operators of pulverized solid fuel combustion facilities to operate their facilities in a less than optimal economic manner to avoid exceeding the physical limits of conventional pulverized solid fuel nozzle tips.

Two such limiting material properties are the ability of a stainless steel pulverized solid fuel nozzle tip to maintain its structural integrity at a high temperature (i.e., the maximum operating temperature) and the wear resistance of the pulverized solid fuel nozzle tip. A common maximum operating temperature for a stainless steel pulverized solid fuel nozzle tip is about 2100 degrees Fahrenheit (2100° F.), though it is not uncommon that the actual operating temperature of the pulverized solid fuel combustion facility can reach or exceed 2500 degrees Fahrenheit (2500° F.). Although there exist design and operating approaches which are configured to prevent exposure of the pulverized solid fuel nozzle tip to the actual pulverized solid fuel combustion facility operating temperature such as, for example, providing cooling air within or around the pulverized solid fuel nozzle tip, there is still some risk that the pulverized solid fuel nozzle tip may nonetheless be exposed to temperatures above the recommended maximum operating temperature in spite of the use of such design and operating approaches. For example, in the event that cooling air, which would normally protect a pulverized solid fuel nozzle tip, is, in fact, not supplied, or is only inadequately supplied, the pulverized solid fuel nozzle tip may be exposed to temperatures greater than its recommended maximum operating temperature. Excess exposure to temperatures beyond a recommended maximum operating temperature may cause a stainless steel pulverized solid fuel nozzle tip to fail during operation, causing negative economic impact.

The relatively modest wear resistance properties of the stainless steel in a stainless steel pulverized solid fuel nozzle tip may so compromise the pulverized solid fuel nozzle tip that the pulverized solid fuel nozzle tip fails between regularly scheduled maintenance outages, thus leading to the necessity of replacing the pulverized solid fuel nozzle tip at an unscheduled, economically disadvantageous time. While the wear resistance of a stainless steel pulverized solid fuel nozzle tip may be enhanced by measures such as, for example, coating the leading edges of the splitter plates of the pulverized solid fuel nozzle tip with a wear resistant material, such measures add to the manufacturing complexity and the weight of the thus treated pulverized solid fuel nozzle tip, thus detrimentally adding to the costs of the pulverized solid fuel nozzle tip.

In addition to those typical characteristics of a stainless steel pulverized solid fuel nozzle tip which may lead to unplanned operational failure, there are other characteristics of a stainless steel pulverized solid fuel nozzle tip which detract from the desirability of such pulverized solid fuel nozzle tips. For example, depending upon the pulverized solid fuel combustion facility and the type of pulverized solid fuel being combusted, a stainless steel pulverized solid fuel nozzle tip may experience slag build up attributable, in part, to the tendency of slag to bond to the surface of stainless steels. If the slag build up continues, the pulverized solid fuel nozzle tip may ultimately be completely blocked to through flow of the pulverized solid fuel.

One solution to the deficiencies of stainless steel pulverized solid fuel nozzle tips discussed above is found in U.S. Pat. No. 6,439,136 entitled "Pulverized Solid Fuel Nozzle Tip With Ceramic Component", which issued on Aug. 27, 2002 and which is assigned to the same assignee as the present patent application, the contents of which are incorporated herein in their entirety. U.S. Pat. No. 6,439,136 provides a pulverized solid fuel nozzle tip having a single shell comprised of a ceramic material such as, for example, silicon nitride, siliconized silicon carbide (having a silicon content of between about twenty percent (20%) to sixty percent (60%) by weight, mullite bonded silicon carbide alumina composite, and alumina zirconia composites.

The single shell of the ceramic nozzle tip is of a unitary construction, i.e., is formed as a single ceramic piece. It has been found that during normal operating conditions this single shell is subject to cracking due to thermal expansion and contraction, i.e., thermal stresses. As will be appreciated, such a failure results in an economic loss for those utilizing the nozzle tip. Accordingly, a need exists for a ceramic pulverized solid fuel nozzle tip that remedies the deficiencies of the above-described ceramic pulverized solid fuel nozzle tip.

OBJECTS OF THE INVENTION

It is an object of the present invention to provide a new and improved solid fuel nozzle tip for use in a firing system of the type utilized in pulverized solid fuel-fired furnaces.

It is a further object of the present invention to provide a new and improved solid fuel nozzle tip for use in a firing system of the type utilized in a pulverized solid fuel-fired furnace that is comprised of a ceramic material.

The above-stated objects, as well as other objects, features, and advantages, of the present invention will become readily apparent from the following detailed description which is to be read in conjunction with the appended drawings.

SUMMARY OF THE INVENTION

In accordance with one embodiment of the present invention, there is provided a solid fuel nozzle tip. The subject solid fuel nozzle tip, in accordance with this one embodiment of the present invention, is constructed in multiple ceramic sections so as to better withstand thermal stresses. In particular, the first embodiment includes a first ceramic shell and a second ceramic shell. The ceramic from which the first and second shells are made could be any type of ceramic suitable for use in a solid fuel nozzle tip. However, in certain aspects, the ceramic is from a group of ceramic materials including silicon nitride, siliconized silicon carbide (having a silicon content of between about twenty percent (20%) to sixty percent (60%) by weight), mullite bonded silicon carbide alumina composite, reaction-bonded silicon carbide, and alumina zirconia composites.

The first ceramic shell and the second ceramic shell are configured to be interconnected with one another. More particularly, each ceramic shell has an inlet end and an outlet end. The outlet end of the first ceramic shell is configured to be interlocked with the inlet end of the second ceramic shell. In this manner, pulverized solid fuel entering the first ceramic shell's inlet end, from a pulverized solid fuel nozzle, passes through the outlet end of the first ceramic shell and into the inlet end of the second ceramic shell.

In one aspect of this embodiment of the present invention, the first ceramic shell and the second ceramic shells interconnect by at least one dovetail joint. A dovetail joint, which is similar to the connection between two pieces of a jigsaw puzzle, is made up of a tenon, or protrusion, formed in one of the first and second ceramic shells, and a mortise, or recess, formed in the other one of the first and second ceramic shells. Thus, with a dovetail joint, two shells will slide together to interconnect.

According to a further aspect of this embodiment of the present invention, the dovetail joint prevents the first and second ceramic shells from moving along a first axis, i.e., in a first direction. A hole is formed through the first ceramic shell and into the second ceramic shell. A connector, such as a pin or other straight object, may be inserted into the hole to prevent movement of the first and second shells along a second axis different than the first axis.

In yet another aspect of this embodiment of the present invention, the solid fuel nozzle tip includes a third ceramic shell. This third ceramic shell is configured to be interconnected with the second ceramic shell. Similar to the discussion above, the outlet end of the second ceramic shell is configured to be interlocked with an inlet end of the third ceramic shell. Thus, solid fuel passes through the outlet end of the second ceramic shell and into the inlet end of the third ceramic shell.

According to a further aspect of this embodiment of the present invention, the solid fuel nozzle tip includes at least one splitter plate. A splitter plate, in this aspect, is adapted to be inserted into the second and third ceramic shells. In other words, such a splitter plate would reside within the shells and be supported by the shells themselves. A splitter plate could be any type of splitter plate known in the art, including, but not limited to, a splitter plate having one or more tapered edges, and/or a low $NO_x$ splitter plate. Preferably, the at least one splitter plate is ceramic. In an especially beneficial further aspect, the at least one splitter plate restrains movement of the second and third ceramic shells. That is, the shells cannot slide apart if a splitter plate is present.

In another embodiment of the present invention, a solid fuel nozzle tip for use in cooperative association with a pulverized solid fuel nozzle of a firing system of a pulverized solid fuel-fired furnace is provided. This embodiment includes three ceramic shells, similar to those discussed above. An inlet end of the first ceramic shell is interconnected with the pulverized solid fuel nozzle. An outlet end of the first ceramic shell is interconnected with the inlet end of the second ceramic shell, and an outlet end of the second ceramic shell is interconnected with an inlet of the third ceramic shell. Thus, pulverized solid fuel that enters the inlet end of the first ceramic shell will exit the outlet end of the third ceramic shell. In further aspects of this embodiment, multiple dovetail joints are provided for interconnecting the three ceramic shells. In an even further aspect, at least one splitter plate is disposed within the three ceramic shells that are interconnected with dovetail joints. And finally, in addition to the dovetail joints, the first and second ceramic shells are also restrained with at least one pin that extends through the first ceramic shell and into the second ceramic shell.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF A PREFERRED EMBODIMENT

Figure 1A:
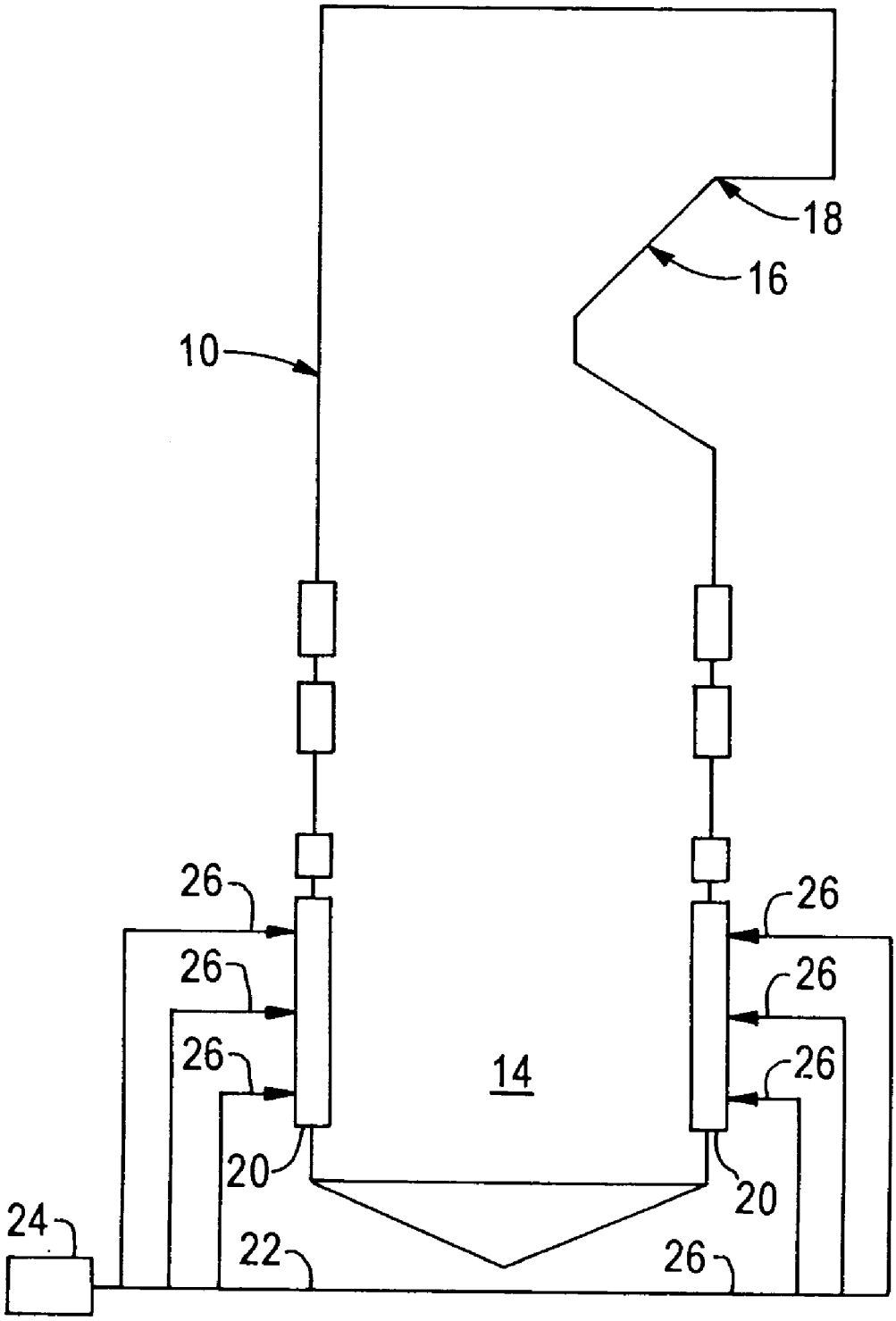
FIG. 1*a* is a diagrammatic representation in the nature of a vertical sectional view of a pulverized solid fuel-fired furnace embodying a firing system with which a solid fuel nozzle tip in accordance with the present invention may be utilized.

FIG. 1*a* depicts an exemplary pulverized solid fuel-fired furnace, generally designated by reference numeral 10, with which the new and improved pulverized solid fuel nozzle tip disclosed herein can be utilized. Inasmuch as the nature of the construction and the mode of operation of pulverized solid fuel-fired furnaces are well known to those skilled in the art, it is not deemed necessary to set forth herein a detailed description of the pulverized solid fuel-fired furnace 10. Rather, a description of the nature of the components of the pulverized solid fuel-fired furnace 10 is deemed to be sufficient. For a more detailed description of the nature of the construction and the mode of operation of the components of the pulverized solid fuel-fired furnace 10 and of a firing system with which the pulverized solid fuel-fired furnace 10 is suitably provided, one may have reference to the prior art, i.e., in the case of the pulverized solid fuel-fired furnace 10 to U.S. Pat. No. 4,719,587, which issued Jan. 12, 1988 to F. J. Berte and which is assigned to the same assignee as the present patent application and, in the case of the firing system with which the pulverized solid fuel-fired furnace 10 is suitably provided, to U.S. Pat. No. 5,315,939, which issued May 31, 1994 to M. J. Rini et al. and which is assigned to the same assignee as the present patent application.

Referring further to FIG. 1*a*, the pulverized solid fuel-fired furnace 10 includes a burner region 14. It is within the burner region 14 that, in a manner well-known to those skilled in this art, combustion of the pulverized solid fuel and air is initiated. The hot gases that are produced from the combustion rise upwardly in the pulverized solid fuel-fired furnace 10. During the upwardly movement thereof the hot gases, in a manner well-known to those skilled in this art, give up heat to fluid passing through tubes (not shown in the interest of maintaining clarity of illustration in the drawing) that in conventional fashion line all four of the walls of the pulverized solid fuel-fired furnace 10. Then, the hot gases exit the pulverized solid fuel-fired furnace 10 through the horizontal pass 16, which in turn leads to the rear gas pass 18. Both the horizontal pass 16 and the rear gas pass 18 commonly contain other heat exchanger surfaces (not shown) for generating and superheating steam. Thereafter, the steam commonly is made to flow to a turbine (not shown), which forms one component of a turbine/generator set (not shown), such that the steam provides the motive power to drive the turbine (not shown) and thereby also the generator (not shown), which in known fashion is cooperatively associated with the turbine, such that electricity is thus produced from the generator (not shown).

The subject firing system with which the pulverized solid fuel-fired furnace 10 is provided includes a housing preferably in the form of a main windbox, which is identified in FIG. 1*a* by the reference numeral 20. In a manner well-known to those skilled in the art, the windbox 20 is provided with a plurality of air compartments (not shown) through which air supplied from a suitable source thereof (not shown) is injected into the burner region 14. In addition, the windbox 20, also in a manner well-known to those skilled in the art, is provided with a plurality of fuel compartments (not shown) through which solid fuel is injected into the burner region 14. The solid fuel is supplied to this plurality of fuel compartments (not shown) by means of a pulverized solid fuel supply means, denoted generally by the reference numeral 22. To this end, the pulverized solid fuel supply means 22 includes a pulverizer 24 and a plurality of pulverized solid fuel ducts 26. In a fashion well-known to those skilled in the art, the pulverized solid fuel is transported through the pulverized solid fuel ducts 26 from the pulverizer 24 to which the pulverized solid fuel ducts 26 are connected in fluid flow relation to the previously mentioned plurality of fuel compartments (not shown). Although not shown in the interest of maintaining clarity of illustration in the drawing, the pulverizer 24 is operatively connected to a fan (not shown), which in turn is operatively connected in fluid flow relation with the previously mentioned plurality of air compartments (not shown), such that air is supplied from the fan (not shown) to not only the aforesaid plurality of air compartments (not shown) but also to the pulverizer 24 whereby the pulverized solid fuel supplied from the pulverizer 24 to the aforesaid plurality of fuel compartments (not shown) is transported through the pulverized solid fuel ducts 26 in an air stream in a manner which is well known to those skilled in the art of pulverizers.

Figure 1B:
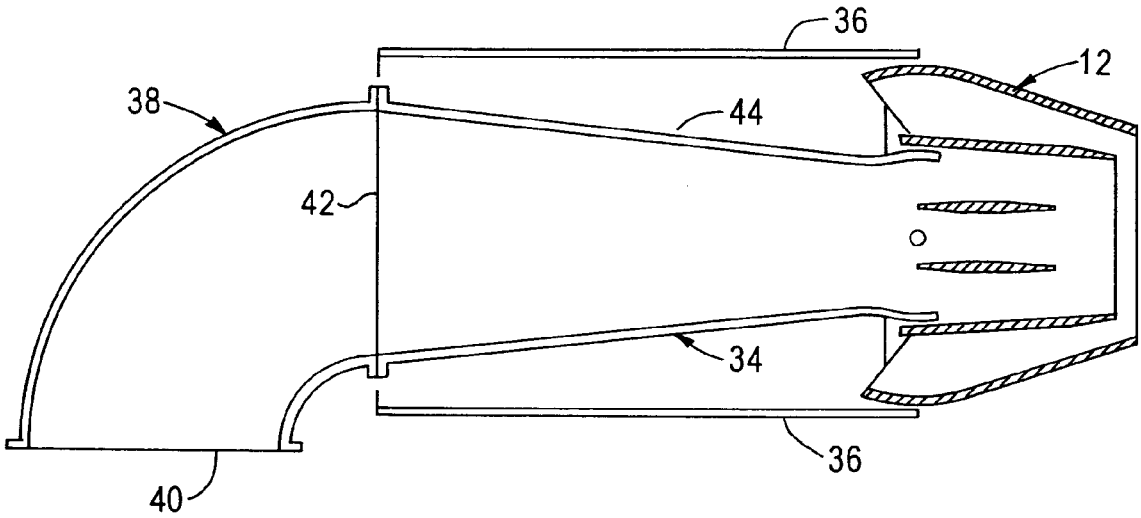
FIG. 1*b* is a simplified depiction of a pulverized solid fuel nozzle of the type employed in the firing system of the pulverized solid fuel-fired furnace that is illustrated in FIG. 1 that may be utilized with the solid fuel nozzle tip of the present invention.

Referring next to FIG. 1*b*, there is depicted therein a pulverized solid fuel nozzle, denoted generally therein by the reference numeral 34. In accordance with the illustration thereof in FIG. 1*b*, the pulverized solid fuel nozzle 34 is depicted as being associated with a solid fuel nozzle tip 12 which could be constructed in accordance with the present invention, or otherwise. A pulverized solid fuel nozzle 34, in a manner well-known to those skilled in the art, is suitably supported in mounted relation within each of the plurality of fuel compartments (not shown) to which reference has been had hereinbefore. In this regard, a schematic representation of one of the plurality of fuel compartments (not shown) is denoted in FIG. 1*b* by the reference numeral 36.

Any conventional form of mounting means suitable for use for such a purpose may be employed to mount the pulverized solid fuel nozzle 34 in the fuel compartment 36. The pulverized solid fuel nozzle 34, as best understood with reference to FIG. 1*b*, includes an elbow-like portion denoted by the reference numeral 38 that is designed, although it has not been depicted in FIG. 1*b* in the interest of maintaining clarity of illustration therewithin, to be operatively connected at one end, i.e., the end thereof denoted in FIG. 1*b* by the reference numeral 40, to a pulverized solid fuel duct 26. The other end, i.e., that denoted by the reference numeral 42, of the elbow-like portion 38, as seen with reference to FIG. 1*b* of the drawing, is operatively connected through the use of any conventional form of fastening means suitable for use for such a purpose to the longitudinally extending portion, denoted by the reference numeral 44. The length of the longitudinally extending portion 44 is such as to essentially correspond to the depth of the fuel compartment 36.

Figure 2:
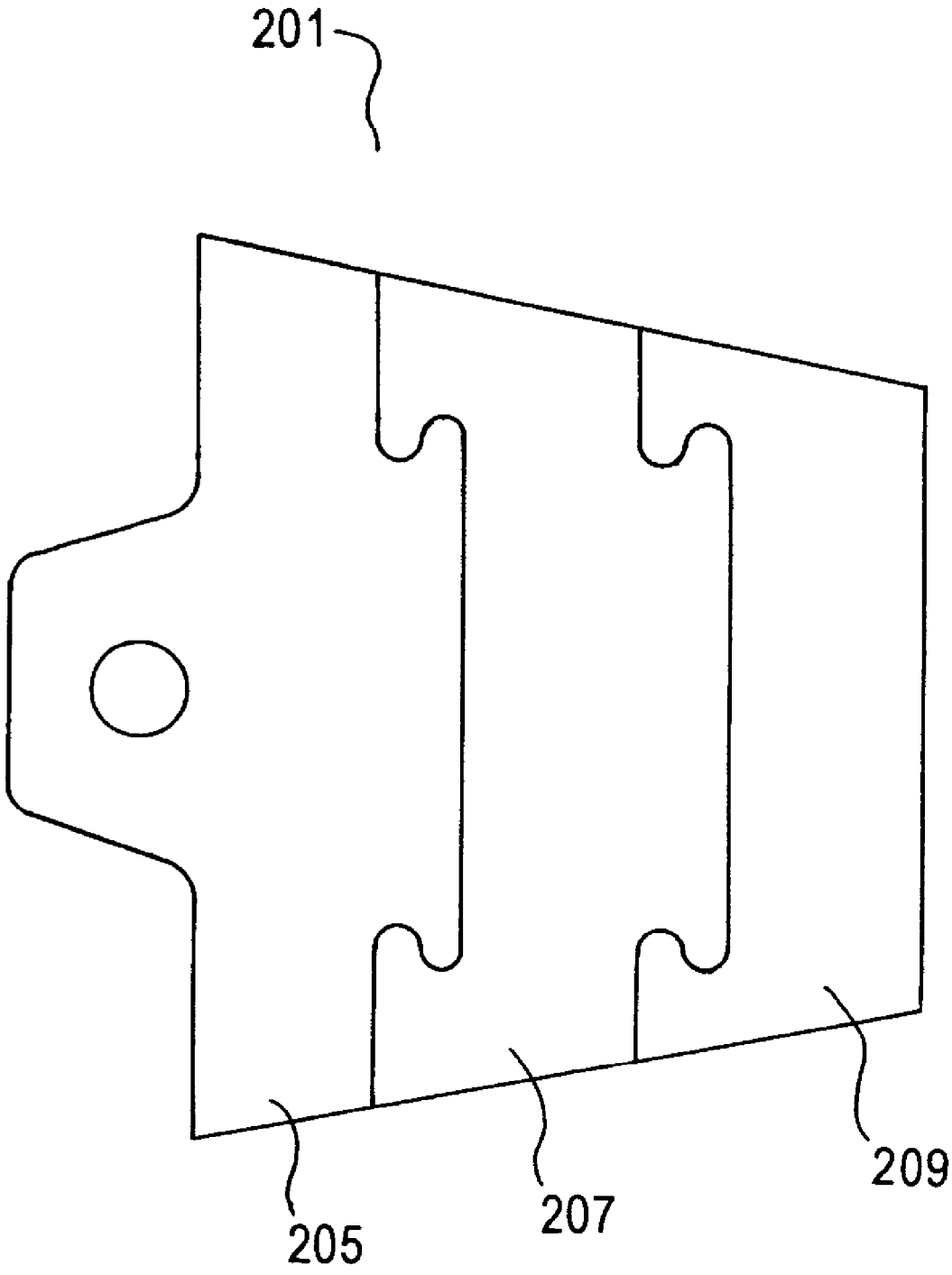
FIG. 2 is a first side view of the solid fuel nozzle tip of the present invention.

FIG. 2 depicts a ceramic pulverized solid fuel nozzle tip 201 usable with the pulverized solid fuel nozzle 34 in accordance with the present invention. The pulverized solid fuel nozzle tip 201 incorporates the advantages of the nozzle tip disclosed in U.S. Pat. No. 6,439,136 while overcoming the deficiencies thereof noted above. The pulverized solid fuel nozzle tip 201 includes three segments, inlet segment 205, middle segment 207, and outlet segment 209, that connect in an interlocking dovetail fashion and through which a pulverized fuel and air mixture is directed into burner region 14.

Figure 3:
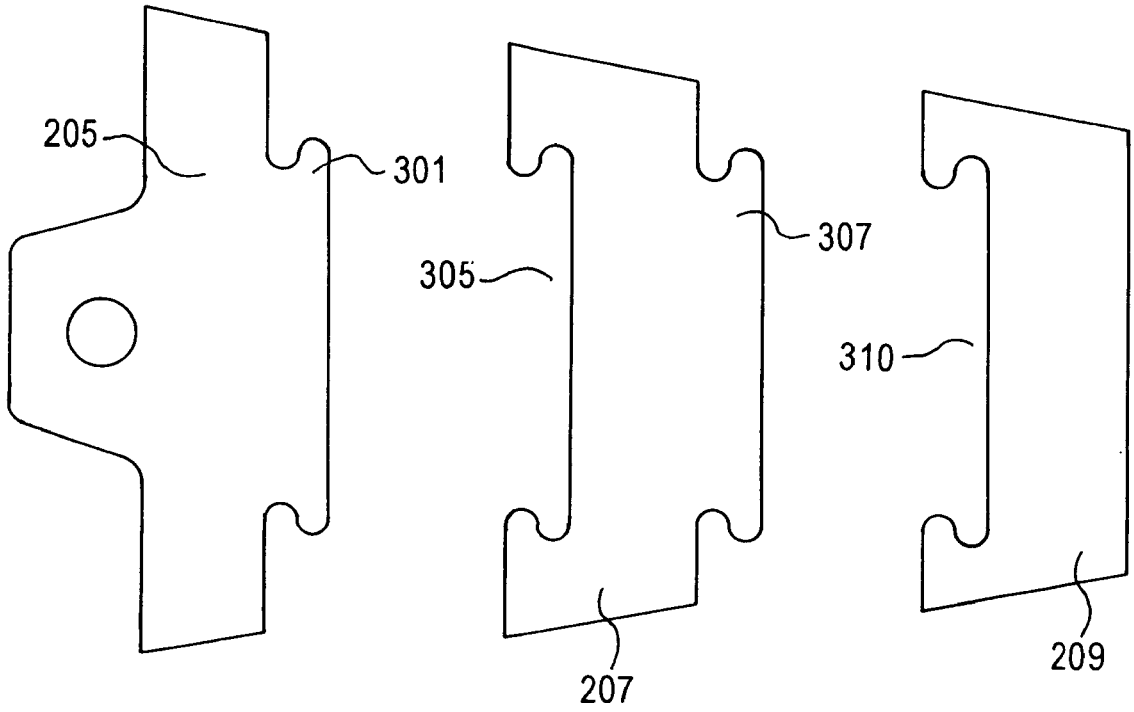
FIG. 3 is an expanded side view of the solid fuel nozzle tip illustrated in FIG. 2.
Figure 4:
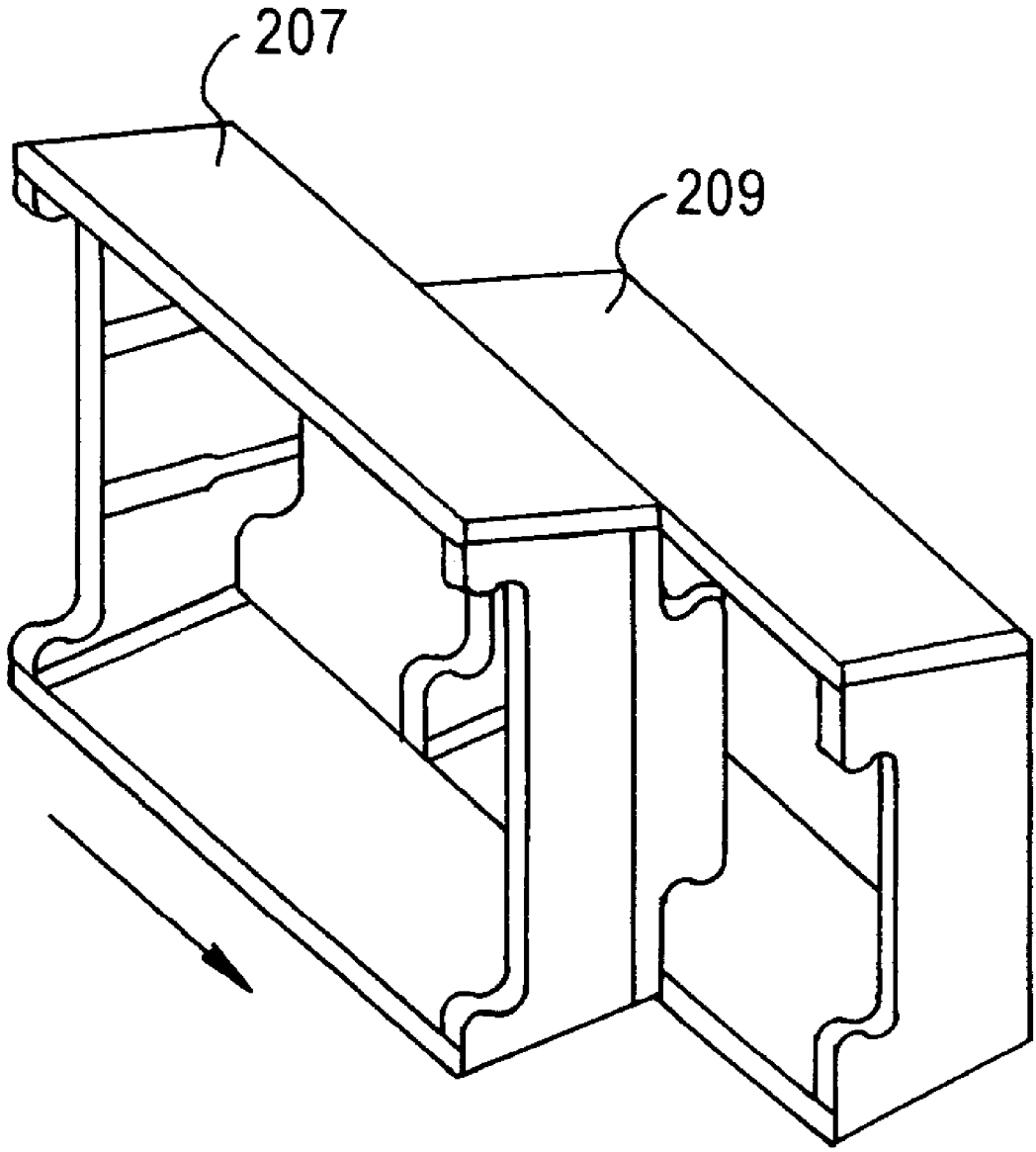
FIG. 4 depicts the interconnection of two sections of the solid fuel nozzle tip illustrated in FIG. 2.

To better illustrate the manner in which the three segments of the pulverized solid fuel nozzle tip 201 interlock, attention is directed to FIG. 3 and FIG. 4. FIG. 3 depicts the three segments not connected with one another. As shown in FIG. 3, inlet segment 205 includes protrusion 301. Protrusion 301 is configured to slideably connect with recess 305 which is formed in middle segment 207. Middle segment 207 also includes protrusion 307 which is configured to slideably connect with recess 310 formed in outlet segment 209. FIG. 4 depicts middle segment 207 and outlet segment 209 being slid together.

Due to the dovetail configuration, the multiple segments float in relation to one another. This floating allows the pulverized solid fuel nozzle tip 201 to accommodate thermal stresses caused by exposure to the heat of normal operating conditions without cracking because those forces are apportioned among the multiple segments such that no one segment is subjected to more thermal expansion and contraction than it can accommodate. Also, the pulverized solid fuel nozzle tip 201 accommodates the thermal stresses because each segment is isolated from adjoining segments due to the gaps between adjoining segments.

Preferably, the ceramics employed in the solid fuel nozzle tip 201 are silicon nitride, siliconized silicon carbide (having a silicon content of between about twenty percent (20%) to sixty percent (60%) by weight), mullite bonded silicon carbide alumina composite, reaction-bonded silicon carbide, or alumina zirconia composites. However, any ceramic capable of withstanding operating conditions to which a solid fuel nozzle tip is subjected may be utilized. In the selection of the ceramic for the solid fuel nozzle tip 201, some ceramics may have a more desirable property in one respect while having a less desirable property in another respect as compared to another ceramic or other ceramics under consideration. Thus, it may not be possible to identify a particular ceramic as significantly more desirable than the other ceramics which may be also suitable for employment in the solid fuel nozzle tip 201. However, to the extent possible, it is desirable that the strength of the ceramic as measured, for example, by a flexural strength test, be relatively high so as to enable the ceramic to more successfully resist deformation. Also, in applications in which pulverized solid fuel being injected through the solid fuel nozzle tip 201 is itself at a relatively high feed temperature such as, for example, pulverized coal which has been pre-heated, or in applications in which the solid fuel nozzle tip 201 is exposed to a relatively high temperature at its outlet such as, for example, an application in which the solid fuel nozzle tip 201 is mounted in a windbox of a pulverized coal fuel-firing furnace, it may be particularly desirable to select a ceramic which has a good resistance to thermal shock. A ceramic having a good resistance to thermal shock may be characterized, for example, by a high thermal conductivity and a low coefficient of thermal expansion.

One advantage of composing the solid fuel nozzle tip 201 of a ceramic material of the group of ceramic materials comprised of ceramics having silicon nitride, siliconized silicon carbide (having a silicon content of between about twenty percent (20%) to sixty percent (60%) by weight), mullite bonded silicon carbide alumina composite, reaction-bonded silicon carbide, or alumina zirconia composites is that these ceramics are more likely than other ceramic materials to better tolerate the temperature differentials typically experienced by a pulverized solid fuel nozzle tip. These temperature differentials are the differences in temperature experienced by the pulverized solid fuel nozzle tip within a predetermined period. Relatively rapid or large temperature fluctuations can stress a pulverized solid fuel nozzle tip comprised of ceramic material to failure although, as noted, the ability of the pulverized solid fuel nozzle tip to withstand such stresses can be improved by appropriate selection of the ceramic material.

Figure 5:
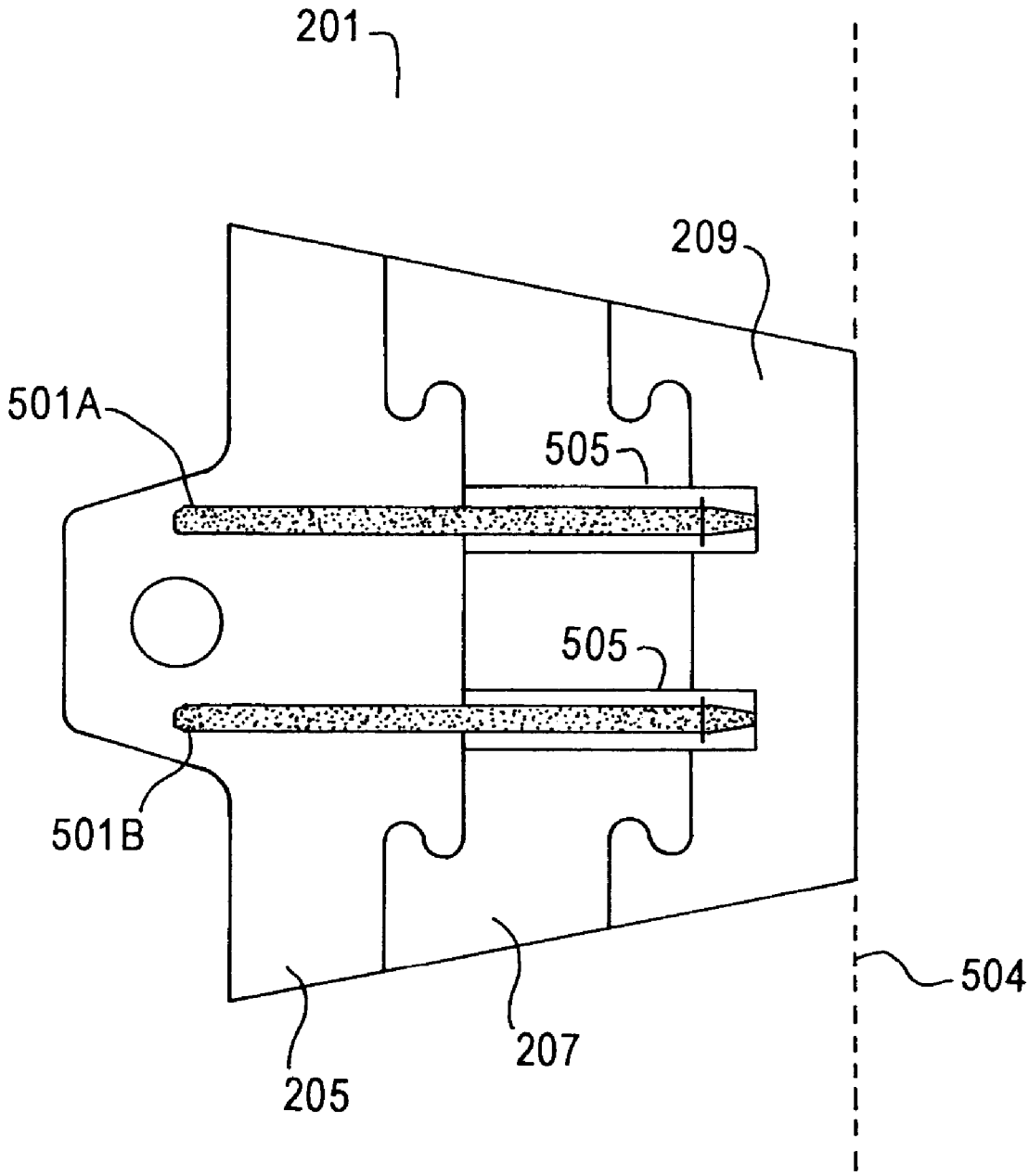
FIG. 5 is a second side view of the solid fuel nozzle tip of the present invention showing splitter plates.

The pulverized solid fuel nozzle tip 201 also includes, as shown in FIG. 5, splitter plates 501A and 501B, preferably also ceramic. Although two individual splitter plates are disclosed herein, it is to be understood that a different number of individual splitter plates could be utilized without departing from the essence of the present invention.

As shown in FIG. 5, each splitter plate 501A and 501B is recessed within the exit plane 504 of the pulverized solid fuel nozzle tip 201. By being so recessed each splitter plate 501A and 501B is thereby removed as a surface susceptible to potential deposition arising from the firing zone, as will be recognized by one of ordinary skill in the art. Also, such recessing of a splitter plate is effective for purposes of providing some cooling to that splitter plate means by virtue of the shielding effect provided thereto by the outlet segment 209. In addition, such recessing of splitter plates 501A and 501B results in a splitter plate that is shorter in length, which in turn thus has the effect of reducing the contact surface for heat transfer thereto as well as reducing the contact surface for the deposition of particles thereon.

In addition, each of splitter plates 501A and 501B is also characterized in a second respect by the fact that the ends of splitter plates 501A and 501B closest to the exit plane 504, i.e., the trailing edge of a splitter plate, is tapered by a predetermined amount to prevent the separation of the primary air that flows on either side thereof. As will be understood, if such separation of the primary air were to occur, it could have the effect of creating additional unwanted flow recirculation. Such tapering of the trailing edges of splitter plates 501A and 501B is effective in reducing the recirculation region that has served to adversely affect the operation of prior art forms of solid fuel nozzle tips, which are characterized by the fact that they embody a blunt faced trailing edge. Secondly, such tapering of the trailing edges of the splitter plates 501A and 501B is effective in reducing the shed vortices that are created by blunt faced trailing edges. If the splitter plates 501A and 501B were to embody blunt ends, the recirculation region induced thereby would operate to draw hot particulate back thereto and thus would have the effect of creating or exacerbating the solid fuel deposition phenomena. Such a recirculation region is also capable of providing conditions conducive to combustion, thus creating flames within the recirculation region, which would have the effect of raising temperatures and further exacerbating the deposition problem.

Alternatively, though not depicted in the FIGS., the splitter plates 501A and 501B could be configured as low $NO_x$ splitter plates for minimizing carbon in the flyash produced from burning the pulverized solid fuel. As will be understood with reference to U.S. Pat. No. 6,439,136, in such a case integrally formed with each splitter plate 501A and 501 B are a first set of bluff bodies and a second set of bluff bodies. The first set of bluff bodies is cooperatively associated with a splitter plate so as to project upwardly relative thereto, i.e., so as to project above the centerline of that splitter plates. In contrast, the second set of bluff bodies is cooperatively associated with the splitter plate so as to project downwardly relative thereto, i.e., so as to project below the centerline of that splitter plate. When present, the bluff bodies are formed at the trailing edge of a respective one of the splitter plates 501A and 501B.

Each bluff body is withdrawn 0.5 to 2.0 inches from both the outlet segment 209 and the exit plane 504 of the pulverized solid fuel nozzle tip 201 such that the high turbulence region of the solid fuel stream is encased within a low turbulence solid fuel "blanket". The effect of the bluff bodies is to maximize turbulence and vortex shedding while yet maintaining the ability of the pulverized solid fuel nozzle tip 201 to tilt and to direct the solid fuel stream. As desired, a greater number of low $NO_x$ splitter plates than two could, as desired, be utilized.

Figure 6:
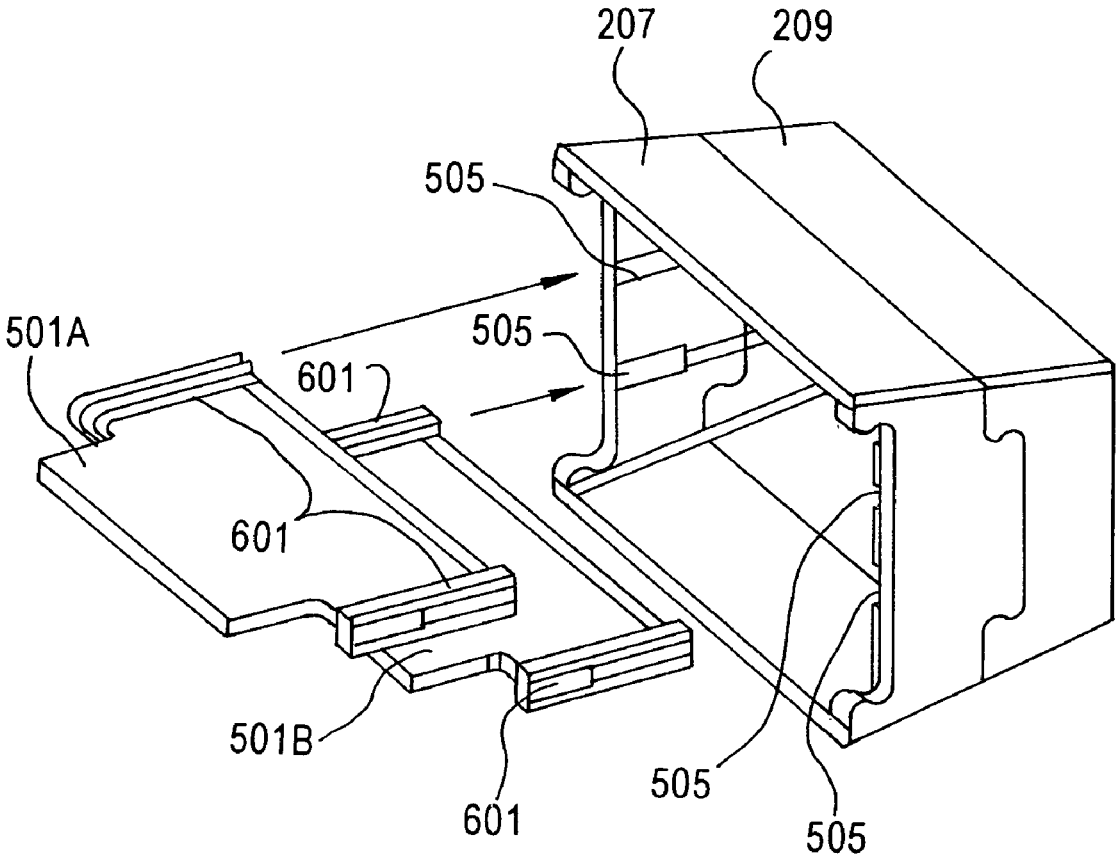
FIG. 6 is another view of the solid fuel nozzle tip of the present invention showing the splitter plates of FIG. 5.

The splitter plates 501A and 501B, whether configured as low $NO_x$ splitter plates or not, also serve to lock together middle segment 207 and outlet segment 209 utilizing recesses, each designated 505, formed in middle segment 207 and outlet segment 209. As shown in FIG. 6, after middle segment 207 and outlet segment 209 have been slid together, splitter plates 501A and 501B are slid into the recesses 505. Each splitter plate 501A and 501B includes a pair of guides, each designated 601, which each fit into a recess 505. When inserted into place, each of splitter plates 501A and 501B prevents middle segment 207 and outlet segment 209 from disengaging.

Figure 7:
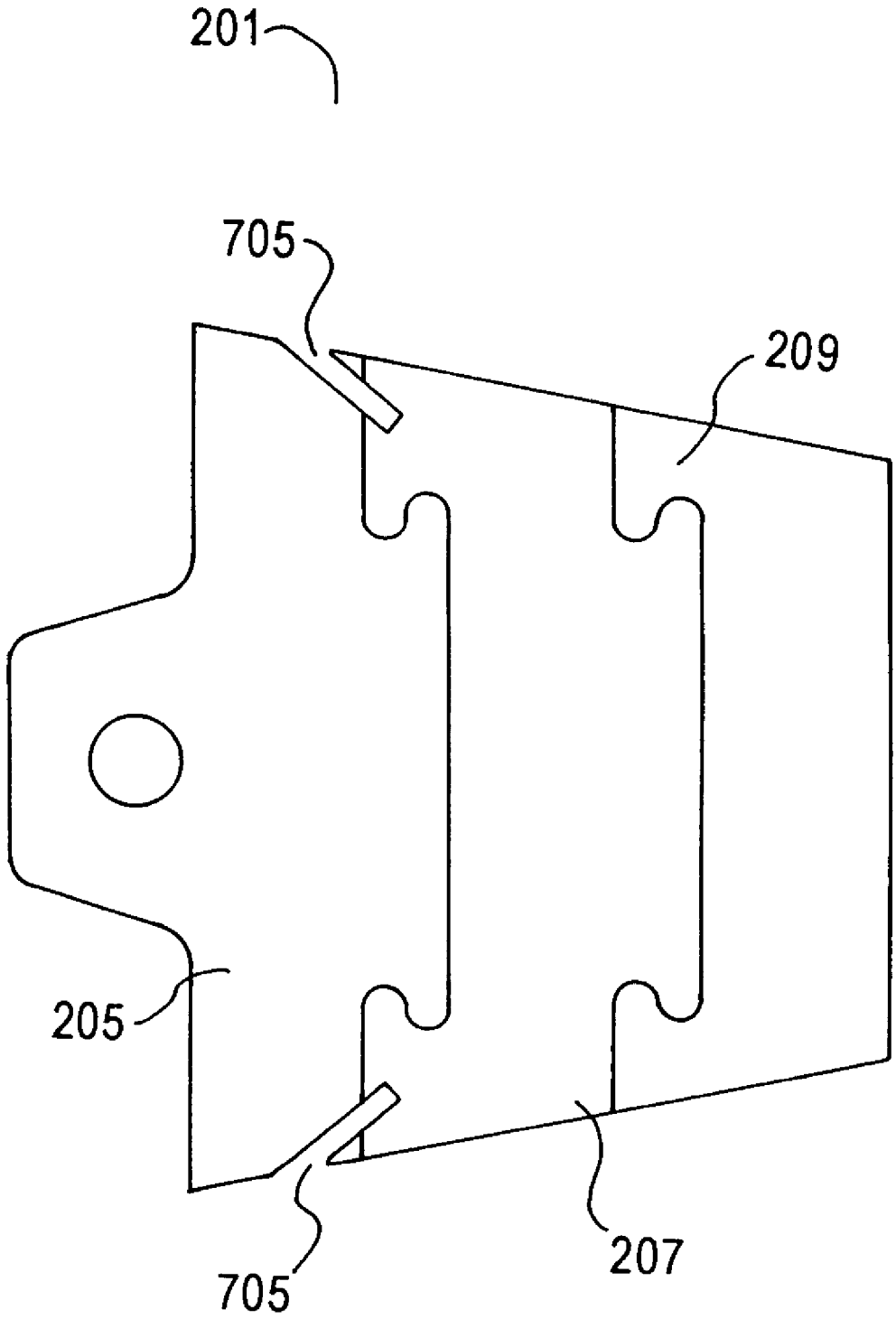
FIG. 7 is a third side view of the solid fuel nozzle tip of the present invention showing holes for pins.
Figure 8:
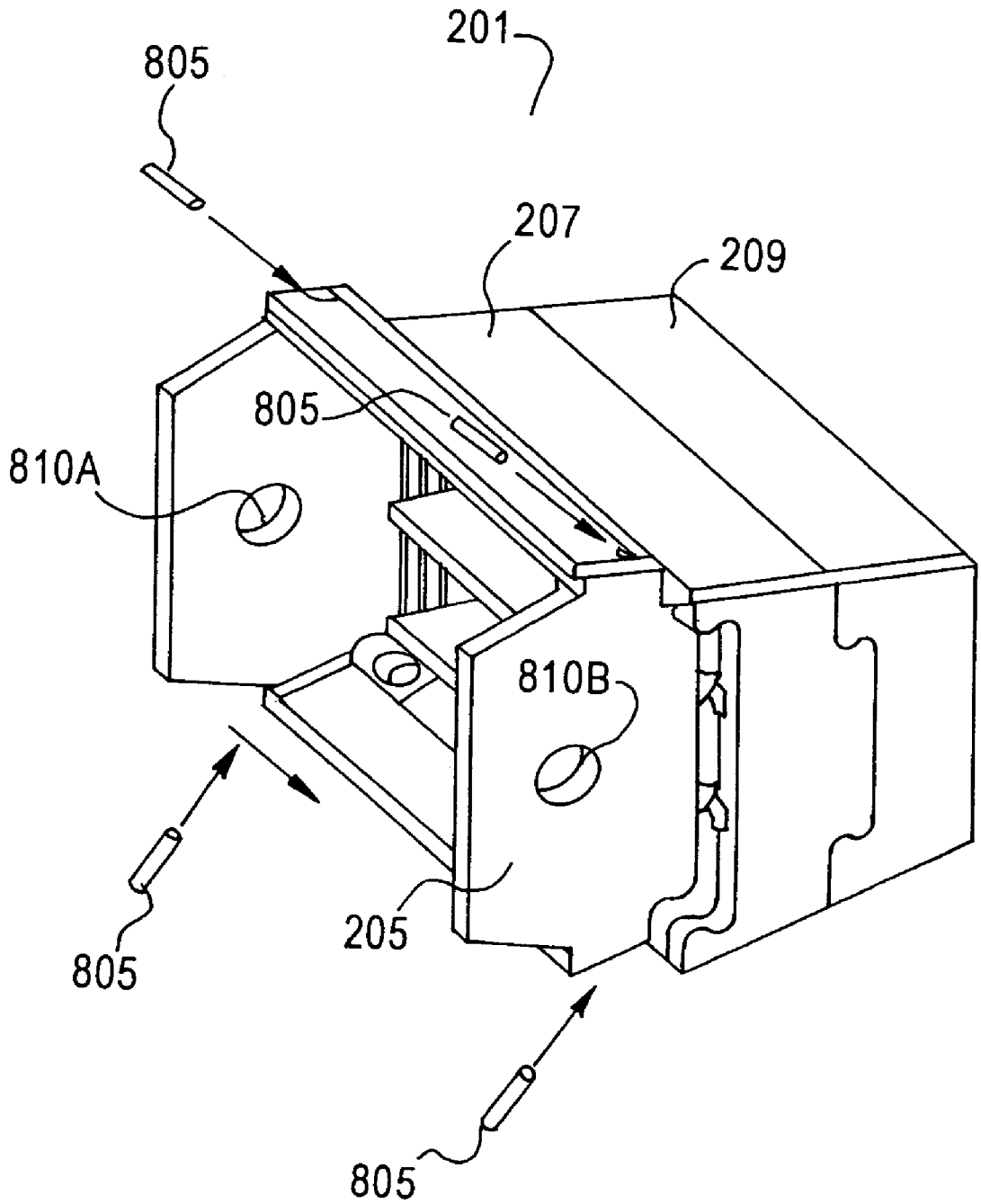
FIG. 8 depicts the solid fuel nozzle tip of the present invention with the pins.

FIG. 7 depicts inlet segment 205 both interlocked with and secured to middle segment 207. Holes, each designated 705, are formed diagonally through inlet segment 205 and into middle segment 207. Preferably, there are four holes 705, however, as desired, a different number of holes 705 could be utilized. As depicted in FIG. 8, a pin, each designated 805, is inserted into each hole 705 to secure inlet segment 205 to middle segment 207. As desired, a grout suitable for the operating environment in which the pulverized solid fuel nozzle tip 201 will be placed can be placed in each hole 705 after a pin 805 has been inserted therein. Further, and also as desired, a grout can be placed in the gap between each of the multiple segments.

Holes 810A and 810B are formed in the inlet segment 205 for pivotally mounting the pulverized solid fuel nozzle tip 201 to a pulverized solid fuel nozzle 34 in a fuel compartment of the furnace 10 with which it is associated. As desired, mounting brackets, such as those disclosed in U.S. Pat. No. 6,439,136 may be utilized with holes 810A and 810B. However, any other known mounting technique may be utilized, as desired.

The present invention is not to be limited in scope by the specific embodiments described herein. Indeed, various modifications of the present invention in addition to those described herein will be apparent to those of skill in the art from the foregoing description and accompanying drawings. Thus, such modifications are intended to fall within the scope of the appended claims.

We claim:

1. A solid fuel nozzle tip, comprising:

a first ceramic shell having an inlet end adapted to interconnect to a solid fuel nozzle and receive a flow of solid fuel from the interconnected solid fuel nozzle, an outlet end distanced from the inlet end, and a chamber having a peripheral wall defining a first passageway for directing the received flow of solid fuel from the inlet end to the outlet end of the first ceramic shell;

a second ceramic shell having an inlet end adapted to interconnect to the outlet end of the first ceramic shell and receive the flow of solid fuel from the interconnected outlet end of the first ceramic shell, an outlet end distanced from the inlet end of the second ceramic shell, and a chamber having a peripheral wall defining a second passageway for directing the received flow of solid fuel from the inlet end to the outlet end of the second ceramic shell, wherein the outlet end of the first ceramic shell and the inlet end of the second ceramic shell are adapted to be interconnected by a dovetail joint formed by the peripheral walls of the chambers of the first and the second ceramic shells, and the dovetail joint restrains movement of the second ceramic shell with respect to the first ceramic shell in a first direction, the outlet end of the first ceramic shell is defined by an end surface and the inlet end of the second ceramic shell is defined by an end surface;

a first hole extending from the end surface of the outlet end of the first ceramic shell into the peripheral wall of the chamber of the first ceramic shell; and a second hole extending from the end surface of the inlet end of the second ceramic shell into the peripheral wall of the chamber of the second ceramic shell;

wherein the outlet end of the first ceramic shell and the inlet end of the second ceramic shell are adapted to be interconnected such that the first and the second holes align;

wherein the first and the second holes are adapted for insertion of a connector to restrain movement of the second ceramic shell with respect to the first ceramic shell in a second direction substantially perpendicular to the first direction.

2. The solid fuel nozzle tip of claim 1, wherein the ceramic of the first ceramic shell and the second ceramic shell is one of the group of ceramics including silicon nitride, siliconized silicon carbide having a silicon content of between about thirty percent (30%) to sixty percent (60%) by weight, mullite bonded silicon carbide alumina composite, reaction-bonded silicon carbide, and alumina zirconia composites.

3. The solid fuel nozzle tip of claim 1, further comprising:

a third ceramic shell having an inlet end adapted to interconnect to the outlet end of the second ceramic shell and receive the flow of solid fuel from the interconnected outlet end of the second ceramic shell, an outlet end distanced from the inlet end of the third ceramic shell, and a chamber having a peripheral wall defining a third passageway for directing the received flow of solid fuel from the inlet end to the outlet end of the third ceramic shell.

4. The solid fuel nozzle tip of claim 3, further comprising:

at least one splitter plate adapted for insertion into the second and third passageways and attachment to the peripheral walls of the chambers of the second and the third ceramic shell.

5. The solid fuel nozzle tip of claim 4, wherein each of the at least one splitter plate is ceramic.

6. The solid fuel nozzle tip of claim 4, wherein:

the outlet end of the second ceramic shell and the inlet end of the third ceramic shell are adapted to be interconnected by a dovetail joint that is formed by the peripheral walls of the chambers of the second and the third ceramic shells and that restrains movement of the third ceramic shell with respect to the second ceramic shell in a first direction; and the at least one splitter plate restrains movement of the third ceramic shell with respect to the second ceramic shell in a second direction substantially perpendicular to the first direction.

7. The solid fuel nozzle tip of claim 1, wherein the first ceramic shell is a first unitary ceramic shell, and the second ceramic shell is a second unitary ceramic shell.

8. A solid fuel nozzle tip for use in cooperative association with a pulverized solid fuel nozzle of a firing system of a pulverized solid fuel-fired furnace, comprising:

a first ceramic shell having an inlet end interconnected to the pulverized solid fuel nozzle so as to receive a flow of solid fuel from the nozzle, an outlet end distanced from the inlet end, and a chamber having a peripheral wall defining a first passageway for directing the received flow of solid fuel from the inlet end to the outlet end of the first ceramic shell;

a second ceramic shell having an inlet end interconnected to the outlet end of the first ceramic shell so as to receive the flow of solid fuel from the first ceramic shell, an outlet end distanced from the inlet end of the second ceramic shell, and a chamber having a peripheral wall defining a second passageway for directing the received flow of solid fuel from the inlet end to the outlet end of the second ceramic shell, wherein the outlet end of the first ceramic shell is defined by an end surface and the inlet end of the second ceramic shell is defined by an end surface;

a third ceramic shell having an inlet end interconnected to the outlet end of the second ceramic shell so as to receive the flow of solid fuel from the second ceramic shell, an outlet end distanced from the inlet end of the third ceramic shell and a chamber having a peripheral wall defining a third passageway for directing the received flow of solid fuel from the inlet end to the outlet end of the third ceramic shell;

a first dovetail joint formed by the peripheral walls of the chambers of the first and the second ceramic shells for interconnecting the inlet end of the second ceramic shell to the outlet end of the first ceramic shell;

a second dovetail joint formed by the peripheral walls of the chambers of the second and the third ceramic shells for interconnecting the inlet end of the third ceramic shell to the outlet end of the second ceramic shell;

at least one splitter plate disposed within the first, the second and the third passageways and attached to the peripheral walls of the chambers of the second and the third ceramic shells;

a first hole in the end surface of the outlet end of the first ceramic shell and extending into the peripheral wall of the chamber of the first ceramic shell, and a second hole, aligned with the first hole, in the end surface of the inlet end of the second ceramic shell and extending into the peripheral wall of the chamber of the second ceramic shell; and a connecting member disposed within the first and the second holes.

9. The solid fuel nozzle tip of claim 8, wherein:

the first dovetail joint restrains movement of the second ceramic shell with respect to the first ceramic shell in a first direction;

the second dovetail joint restrains movement of the third ceramic shell with respect to the second ceramic shell in the first direction;

the connecting member restrains movement of the second ceramic shell with respect to the first ceramic shell in a second direction substantially perpendicular to the first direction; and the at least one splitter plate restrains movement of the third ceramic shell with respect to the second ceramic shell in the second direction.

10. The solid fuel nozzle tip of claim 9, wherein the at least one splitter plate is ceramic.

11. The solid fuel nozzle tip of claim 10, wherein:

the ceramic of the first, the second and the third ceramic shells and the at least one splitter plate is one of the group of ceramics including silicon nitride, siliconized silicon carbide having a silicon content of between about thirty percent (30%) to sixty percent (60%) by weight, mullite bonded silicon carbide alumina composite, reaction-bonded silicon carbide, and alumina zirconia composites.

12. The solid fuel nozzle tip of claim 8, wherein the first ceramic shell is a first unitary ceramic shell, the second ceramic shell is a second unitary ceramic shell, and the third ceramic shell is a third unitary ceramic shell.

* * * * *

UNITED STATES PATENT AND TRADEMARK OFFICE

CERTIFICATE OF CORRECTION

PATENT NO. : 7,216,594 B2
APPLICATION NO. : 11/119942
DATED : May 15, 2007
INVENTOR(S) : Ronald H. Nowak et al.

It is certified that error appears in the above-identified patent and that said Letters Patent is hereby corrected as shown below:

On the Title page of the Letters Patent, replace Assignee Name "Alstom Technology, Ltc." with --ALSTOM Technology Ltd--.

Signed and Sealed this

Fourteenth Day of August, 2007

JON W. DUDAS
*Director of the United States Patent and Trademark Office*